US008487816B2

(12) United States Patent
Säily

(10) Patent No.: US 8,487,816 B2
(45) Date of Patent: Jul. 16, 2013

(54) PATCH ANTENNA ELEMENT ARRAY

(75) Inventor: Jussi Säily, Espoo (FI)

(73) Assignee: Nokia Siemens Networks Oy, Espoo (FI)

( * ) Notice: Subject to any disclaimer, the term of this patent is extended or adjusted under 35 U.S.C. 154(b) by 279 days.

(21) Appl. No.: 12/990,663

(22) PCT Filed: May 5, 2009

(86) PCT No.: PCT/EP2009/055414

§ 371 (c)(1),
(2), (4) Date: Jan. 4, 2011

(87) PCT Pub. No.: WO2009/135839

PCT Pub. Date: Nov. 12, 2009

(65) Prior Publication Data

US 2011/0109524 A1 May 12, 2011

(30) Foreign Application Priority Data

May 5, 2008 (EP) ..... 08103819

(51) Int. Cl.
*H01Q 1/38* (2006.01)

(52) U.S. Cl.
USPC ..... 343/700 MS; 343/767; 343/815

(58) Field of Classification Search
USPC ..... 343/700, 767, 770, 853, 815
See application file for complete search history.

(56) References Cited

U.S. PATENT DOCUMENTS

| | | | | |
|---|---|---|---|---|
| 5,008,681 | A * | 4/1991 | Cavallaro et al. | 343/700 MS |
| 5,418,541 | A * | 5/1995 | Schroeder et al. | 343/700 MS |
| 5,572,222 | A * | 11/1996 | Mailandt et al. | 343/700 MS |
| 5,923,296 | A | 7/1999 | Sanzgiri et al. | 343/700 MS |
| 5,923,303 | A | 7/1999 | Schwengler et al. | 343/853 |
| 5,955,994 | A * | 9/1999 | Staker et al. | 343/700 MS |
| 6,087,988 | A * | 7/2000 | Pozgay | 343/700 MS |
| 7,898,481 | B2 * | 3/2011 | Qian et al. | 343/700 MS |

FOREIGN PATENT DOCUMENTS

| | | |
|---|---|---|
| GB | 2 211 025 A | 6/1989 |
| WO | WO 00/31824 | 6/2000 |

* cited by examiner

*Primary Examiner* — Tho G Phan
(74) *Attorney, Agent, or Firm* — Harrington & Smith

(57) ABSTRACT

A communication network antenna array is described, which includes a first patch antenna element, a second patch antenna element, and a third patch antenna element, wherein the first patch antenna is adapted for transmission and/or reception of electromagnetic radiation polarized in a first direction, wherein the second patch antenna is adapted for transmission and/or reception of electromagnetic radiation polarized in a second direction, wherein the third patch antenna is adapted for transmission and/or reception of electromagnetic radiation polarized in a third direction, wherein the first, the second and the third patch antenna elements are arranged equidistant to a straight axis, and wherein the first direction, the second direction, and the third direction define an acute angle with the straight axis.

13 Claims, 15 Drawing Sheets

PATCH ANTENNA ELEMENT ARRAY

FIELD OF INVENTION

The present invention relates to the field of communication network antenna arrays and a communication network antenna arrangement.

ART BACKGROUND

The present invention relates to wireless local area network (WLAN) access points, WiMAX and other cellular communication base station antennas. Metropolitan area WLAN deployment are developed which is based on wireless backhaul connections between adjacent access points. The backhaul connections operate on a higher frequency range than the mobile access (4.9-5.825 GHz vs. 2.4-2.485 GHz). The WLAN backhaul antenna typically consists of a number of sectors having multiple antennas. A typical number of sectors is between three and six. The construction is a compromise between the cost of antennas and radios and the capacity and operating range.

The sectorized antenna arrays can take advantage of polarization diversity which is good for increasing backhaul link reliability and capacity in urban areas. Commonly dual-polarized antennas are used for the required antennas. The available diversity gains from using space diversity (separate antenna arrays located at least several wavelengths apart) and polarization diversity are essentially equal.

Polarization diversity in backhaul can increase link capacity e.g. through the use of MIMO techniques. A polarization agile access point can use two channels to a single link connection or connect to multiple access points in the same beam using alternate polarizations and/or frequencies. Another possibility is to transmit and receive in alternate polarizations, thus easing hardware design as no duplex filters are needed.

Another possibility to improve reception at the access point or base station is the use of circularly polarized (CP) antennas. This may reduce the number of radios in the access point, and still provide good reception of different polarizations. In comparison to a perfectly matched linear polarization (say, vertical transmit and vertical receive polarization), the CP antenna always exhibits a 3 dB lower gain. But, the polarization mismatch loss is never higher than this and thus a better system performance can be accomplished with arbitrary handheld transmitter polarization orientations.

The sector coverage of dual-polarized patch antenna arrays is typically limited to below 100 degrees. Dipole antennas can be used to reach 120 degree half-power beamwidths, but they require shaped ground planes and more height. Patch antenna arrays with wide horizontal coverage are needed to reduce the number of radios in cost-sensitive access points.

The backhaul connection range is limited by the LOS path loss and antennas need to have a high gain for a decent link span and reliability. High gain is obtained by vertically stacking antenna elements.

The available frequency range of the backhaul connection varies between different standards and countries, and there may be specific bands which need to be covered. For example, the 4.9-5.825 GHz band is divided to many purposes. The available range for wireless backhaul connections in the US is 5.25-5.35 GHz and 5.75-5.825 GHz. Inside the EU, the available range is 5.47-5.725 GHz.

It is difficult to design a dual-polarized single antenna element with a very wide operating bandwidth. The element must typically make compromises between polarizations, e.g. one principal polarization covers the full band and the other just a part of the full band.

Thus, there may be a need for a communication network antenna array, and an antenna arrangement having a wide angular coverage while proving a simple arrangement.

SUMMARY OF THE INVENTION

This need may be met by the subject-matter according to the independent claims. Advantageous embodiments of the present invention are described by the dependent claims.

According to an exemplary aspect of the invention a communication network antenna array is provided, which comprises a first patch antenna element, a second patch antenna element, and a third patch antenna element, wherein the first patch antenna is adapted for transmission and/or reception of electromagnetic radiation polarized in a first direction, wherein the second patch antenna is adapted for transmission and/or reception of electromagnetic radiation polarized in a second direction, wherein the third patch antenna is adapted for transmission and/or reception of electromagnetic radiation polarized in a third direction, wherein the first, the second and the third patch antenna elements are arranged equidistant to a straight axis, and wherein the first direction, the second direction, and the third direction define an acute angle with the straight axis.

In particular, some or all of the patch antenna elements may be single polarized antenna elements. Furthermore, the patch antenna element may be arranged in a single plane. For example, each of the patch antenna elements may have a first and a second main surface which are substantially parallel and the first main surfaces of the different patch antenna elements are arranged in one plane while the second main surfaces of the different patch elements are arranged as well in one plane. The shape and/or size of the patch antenna elements may be identical or may be different, e.g. have the same shape but different sizes so that one patch antenna element forms a scaled version of another patch antenna element. In particular, the patch antenna array may comprise feed lines for each of the patch antenna elements, wherein the feed lines may or may not lay in the same plane as the patch antenna elements.

According to an exemplary aspect of the invention a communication network antenna arrangement is provided, which comprises a plurality of antenna arrays according to an exemplary aspect of the invention. In particular, the plurality of antenna arrays may be arranged along the same straight axis. Preferably, the number of single patch antenna elements may be an even number, i.e. comprises paired patch antenna elements, wherein each pair comprises one patch antenna element which is adapted for electromagnetic radiation polarized in a first direction while the other one is adapted for electromagnetic radiation polarized in a second direction, wherein the first and second direction may form an angle of 60, 90 or 120 degrees with each other. Of course some deviations from the above cited angles will also be possible. Thus, three to six different polarizations may be possible.

The term "acute angle" may particularly denote an angle which is lower than 90 degree. In particular, the acute angle may be significantly less than 90°, e.g. less than 80 degrees.

The term "equidistant" may particularly denote that the distance of one point to another point is substantially the same. Although, small deviations of the distance may occur due to manufacturing differences a monotonous altering of the distances may be excluded. In particular, the deviations of the distance may be small compared to the distance. In an exemplary embodiment, equidistant may particularly denote, that a center, corresponding points, or center of gravity of several antenna elements may have substantially the same distance from the straight axis. However, the different patch antenna elements may be arranged on different sides of the straight axis and may be even placed in a shifted or displaced manner in the direction of the straight axis. That is, the antenna elements may be arranged mirrored on different sides of the straight axis, e.g. in the manner leaves are arranged alternated on a stem.

By providing an antenna array according to an exemplary aspect of the invention it may be possible to provide a slanted polarization with bandwidth control wherein the array uses diagonal modes instead of basic patch modes. Furthermore, it may be possible to provide a small and compact antenna array or antenna arrangement comprising a plurality of patch antenna elements which is mechanically less complex than known antenna arrays. Moreover, it may be possible to provide an antenna arrangement having similar performance for both polarization directions, e.g. for horizontal and vertical polarization. Due to the less complex assembly of an antenna arrangement according to an exemplary embodiment of the invention such an arrangement may be in particular suitable for simpler application like WLAN or WiMAX applications. In addition it may be possible to achieve an antenna arrangement providing for a dual or circular polarization. Circularly polarized antennas may be advantageous in further reducing the number of radios when dual-polarizations are not needed. Furthermore, it may be possible to provide for narrow electromagnetic radiation beams for receiving and wide beams for transmitting links.

Moreover, it may be possible to simplify a beam forming network, e.g. a so-called Butler matrix, for generating desired beams with the help of parasitic elements. In particular, it may be possible to provide a full 4.9-5.825 GHz coverage on two polarizations, for example.

Patch antenna arrays according to an exemplary aspect of the invention may be used for access points or base stations of communication networks, e.g. mobile communication networks. The invention may provide high-performance dual- or circularly-polarized antenna arrays with narrow and wide horizontal beamwidths. The antenna arrays may be suitable for broad frequency bands including RF- micro- and millimeter waves.

A gist of an exemplary aspect of the invention may be seen in providing an antenna arrangement comprising a plurality of patch antenna elements. The patch antenna elements may have a particular pattern which can be described in different ways.

In general the resulting pattern may be described as a slanted antenna array.

One possible more detailed description may be that the antenna array comprises at least two patch antenna elements wherein the first patch antenna is adapted for transmission and/or reception of electromagnetic radiation polarized in a first direction and wherein the second patch antenna is adapted for transmission and/or reception of electromagnetic radiation polarized in a second direction. Furthermore, the first direction and the second direction may define an acute angle with a vertical axis, e.g. an axis vertical to the earth's surface. For instance the acute angle may be in the range between 35 degree and 55 degree, in particular substantially 45 degree. In case of patch antenna elements having a rectangular shape this may lead to an arrangement similar to the one shown in FIG. 2 which will be described later. Of course, the antenna array may comprise more than two patch antenna elements which are arranged with respect to the vertical axis in a corresponding pattern as the first and second patch antenna elements, which may lead to a pattern similar to the one shown in FIG. 3. which will as well be described later on in detail. Additionally, parasitic elements may be arranged beside the patch antenna elements which may be adapted to shape a radiation beam of the antenna array. The parasitic elements may have the same shape as the patch antenna elements and may be arranged in the same pattern as the patch antenna elements but arranged farther away from the vertical axis than the patch antenna elements. The resulting pattern may be similar than the antenna array shown in FIG. 7 which will be described later in detail.

Another possible description may be that the antenna array may comprise at least two patch antenna elements having a rectangular shape. The patch antenna may be arranged in a mirrored and displaced manner with respect to a vertical axis so that the principal axis of the longer side of the rectangular patch antenna elements intersect each other and form a zigzag pattern. Thus, the patch antenna elements may be arranged in a manner that each pair forms a T. When arranging a plurality of such T-shaped arranged pairs of patch antenna elements a so-called interleaved pattern may be achievable which may be suitable to achieve a compact antenna arrangement.

Next, further exemplary embodiments of the communication network patch antenna array are described. However, these embodiments also apply to communication network patch antenna arrangement.

According to another exemplary embodiment of the patch antenna array the first and the third direction are the same.

According to another exemplary embodiment of the patch antenna array the acute angle is in the range between 25 and 65 degree. In particular, the acute angle may be between 35 and 55 degree and even more particularly 45 degree or at least about 45°. However, it should be noted that some small deviations, which usually occurs during manufacturing, are included in the above described ranges.

According to another exemplary embodiment of the patch antenna array the first, second and third patch antenna elements have the same shape. In particular, the shape may be rectangular, however the antenna elements may be mirrored with respect to the straight axis. Moreover, the shape or geometrical design may be optimized with respect to cross polarization isolation, for example the shape may be adapted to result in high cross polarization isolation. This may be done by reducing a radiation patch dimension in the cross-polarization plane.

According to another exemplary embodiment of the patch antenna array adjacent patch antenna elements are arranged on alternative sides of the straight axis. In particular, the antenna elements may have the same shape but may be mirrored with respect to the straight axis.

According to another exemplary embodiment of the patch antenna array an offset of the adjacent patch antenna elements is between 0.2 and 0.4 times the free-space wavelength of the electromagnetic radiation of the respective patch antenna, wherein the offset is measured in parallel to the straight axis. In particular, the offset may be 0.3 times the free-space wavelength of the electromagnetic radiation of the respective patch antenna.

The term "offset" may in particular denote the offset between one point of one patch antenna element to the corresponding point of the adjacent patch antenna element.

According to another exemplary embodiment of the patch antenna array a displacement of the patch antenna elements arranged on the same side of the straight axis is between 0.4 and 0.8 times the free-space wavelength of the electromagnetic radiation of the respective patch antenna, wherein the displacement is measured in parallel to the straight axis. In particular, the displacement may be between 0.5 and 0.7 and more particularly 0.6 times the free-space wavelength of the electromagnetic radiation of the respective patch antenna.

The term "displacement" may in particular denote the displacement between one point of one patch antenna element to the corresponding point of the next patch antenna element arranged on the same side of the straight axis.

According to another exemplary embodiment the patch antenna array further comprises a plurality of parasitic elements arranged farther away from the straight axis than the patch antenna elements. In particular, the parasitic elements may be patch parasitic elements and/or may be placed in the same plane as a fed element for the patch antenna elements.

According to another exemplary embodiment of the antenna array the parasitic elements are shaped and arranged to shape a radiation beam of the antenna array. In particular, they may not be adapted and/or be used in order to improve an impedance bandwidth of the antenna array.

Providing of parasitic elements may be a suitable way to control antenna beamwidth. Such a control may be easily achievable when using an antenna array according to an exemplary embodiment of the invention since a coupling in the array may be less strong and a high-performance dual-slant polarized antenna array may be possible.

According to another exemplary embodiment of the patch antenna array the patch antenna elements have an rectangular shape, the plurality of parasitic elements have the same shape as the patch antenna elements, and the plurality of parasitic elements are arranged in a corresponding pattern to the pattern formed by the patch antenna elements. In particular, the parasitic elements may have only the same shape but may have different sizes than the patch antenna elements, i.e. may have a scaled shape or form of the patch antenna element, or may even have the same size, i.e. may have the identical shape and size, so that the contour of the patch antenna element may be identical.

According to another exemplary embodiment of the patch antenna array at least one of the patch antenna elements comprises a conductive planar layer, and the conductive planar layer comprises at least one slot. In particular, the conductive planar layer may comprise slots having at least substantially the shape of an H. That is, the conductive planar layer may comprise two parallel slots and one additional slot formed perpendicular to the two parallel slots and connecting the parallel slots. The conductive planar layer may be a ground plate having the H-shaped slot. Such an H-shaped ground plate may be in particular suitable to provide a basic broadband proximity-coupled antenna.

According to another exemplary embodiment the patch antenna array further comprises a feed line, and a bridging element, wherein the bridging element bridges the slot, and wherein the feed line leads to the bridging element.

According to another exemplary embodiment of the patch antenna array the straight axis is a vertical axis. In particular, the term vertical axis may denote an axis which is vertical with respect to the earth's surface.

Summarizing an exemplary aspect of the present invention may be seen in providing a compact dual-slant (±45°) polarized antenna array by interleaving single-polarized antenna elements. Thus, there may be provided a polarization agile antenna which may not become too large to practical application since no separate antenna arrays for the two polarizations may be needed. The single-polarized antenna elements may be designed so that they have high cross-polarization isolation by geometrical design. The preferred way may be to reduce the radiating patch dimension in the cross-polarization plane. This type of radiating patch may be ideally suited to slanted polarizations, and the elements can be placed close to each other.

The interleaved antenna elements should be placed in a T-configuration with respect to each other. This may ensure minimum coupling between the antennas. The exemplary element separation may be 0.3 $\lambda_0$ (free-space wavelength) at 5.4 GHz (16.5 mm; $\lambda_0$=55.5 mm).

The antenna elements on both polarizations may be identical in construction and shape but are mirrored over the vertical axis. The elements may be placed on a single line by stacking them in either vertical or horizontal direction. But, the most compact and good performing antenna may be achieved by offsetting the elements so that they are facing each other in the T-configuration mentioned above. FIG. 3, which will be described in detail afterwards, shows the vertically stacked variant of four such basic dual-polarization elements with an exemplary 0.6 $\lambda_0$ displacement or separation. In practice, 0.5-0.7 $\lambda_0$ displacement or separation may be optimal regarding gain and sidelobe levels.

The beamwidth of the array may be controlled by placing parasitic patches arranged in the same vertical or horizontal plane or in offset with regard to the primary radiator. FIG. 7, which will be described later, shows the 4-element dual-polarized array with parasitic patches. The array may be optimized for 120 degree horizontal beamwidths on both polarizations.

By providing a patch antenna array or a patch antenna arrangement according to an exemplary aspect of the invention it may be possible that the basic antenna design without parasitic patches may be applied to a low cost 5 sector antenna design having a good electrical performance and very small Printed Circuit Board (PCB) area. Furthermore, the antenna with parasitic patches may have very wide angular coverage for three sector designs. Moreover, the radiated beams from the wide sector antenna may be much more symmetrical than obtainable with a dual-polarized single-element antenna with similar bandwidth according to the prior art. Additionally, symmetrical patterns may enable the use of circular polarization, which may not be possible with a broadband single-element antenna according to the prior art. In addition circular polarization may be used to reduce the number of radios in a lower cost access point. The new antenna may virtually be the same size as a regular dual-polarized patch antenna, and may be used to upgrade existing access point designs.

It has to be noted that exemplary aspects and exemplary embodiments of the invention have been described with reference to different subject-matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject-matters, in particular between features of the apparatus type claims and features of the method type claims is considered to be disclosed with this application.

The exemplary aspects and exemplary embodiments defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
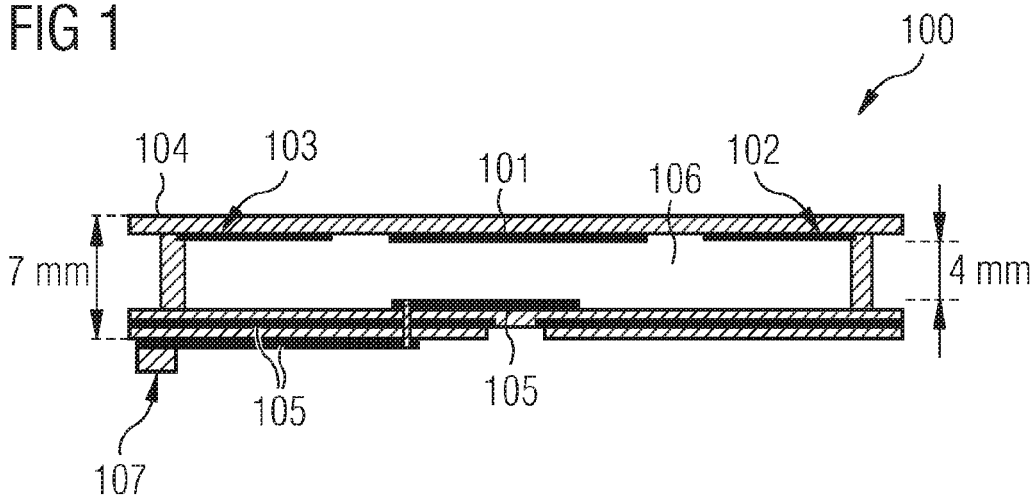
FIG. 1 schematically illustrates a layer diagram of a patch antenna element.

The illustration in the drawing is schematical. Identical or similar elements are labeled with identical or similar reference signs.

In the following, referring to FIGS. 1 to 10, some basic principles of the communication network patch antenna array according to exemplary embodiments will be explained.

FIG. 1 schematically illustrates a layer diagram of a patch antenna element 100. The antenna element is proximity-coupled with an air gap between a feed line and the primary radiator. The optional parasitic patches are arranged on the sides of the primary radiator. In particular, a cross-sectional view of the patch antenna element 100 is shown in FIG. 1. The patch antenna element 100 comprises a primary radiator 101 and parasitic patches 102 and 103, which are all formed by a conductive layer. The conductive layer is arranged in a housing 104 which is shown hatched in FIG. 1. Furthermore, the patch antenna element 100 comprises a multilayer feed line 105, which is arranged opposite to the primary radiator 101 and separated by an air gap 106 from the same. A coaxial connector 107 is used to connect to the patch antenna element 100. A possible dimensioning of the housing is as well shown in FIG. 1. E.g. the patch antenna element 100 may have a total thickness of 7 mm while the air gap 106 may have a thickness of 4 mm.

Figure 2:
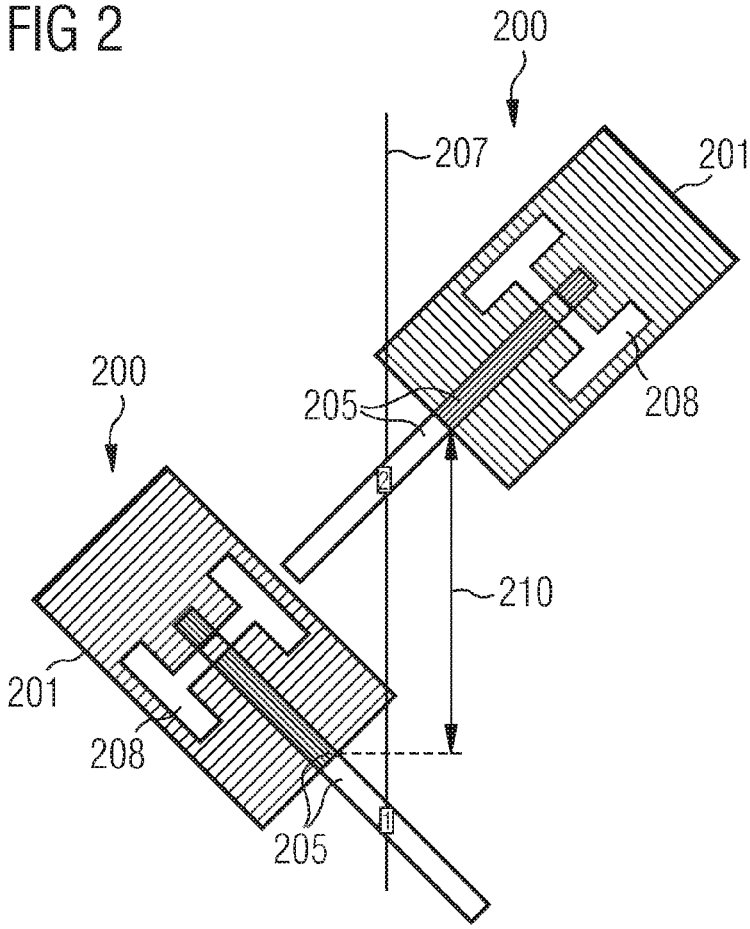
FIG. 2 schematically illustrates a basic dual-polarized antenna unit.

FIG. 2 schematically illustrates a basic dual-polarized antenna unit comprising 2 patch antenna elements. In particular, FIG. 2 schematically shows two patch antenna elements 200 arranged in a slanted arrangement relative to a vertical axis 207. Each patch antenna element 200 comprises a primary radiator 201 which is formed by a conductive layer or sheet and which is connected to a feed line 205. As shown in FIG. 1 the feed lines 205 are separated from the conductive layer of the primary radiator by an air gap which is indicated by the different hatching in FIG. 2. Furthermore, each patch antenna element 200 comprises a slot 208 shaped like an H. The feed line may have a length so that it extends slightly farther than the H-slot.

Thus, the basic dual-polarized antenna unit is obtained by placing two (orthogonally oriented) single-polarized antenna elements close to each other like shown in FIG. 2. Their positions with each other may be optimized for minimum mutual coupling. In particular, a T-configuration may give the best results. The exemplary element offset or separation 210 is 0.3 $\lambda_0$ (free-space wavelength) at 5.4 GHz (16.5 mm; $\lambda_0$=55.5 mm).

Figure 3:
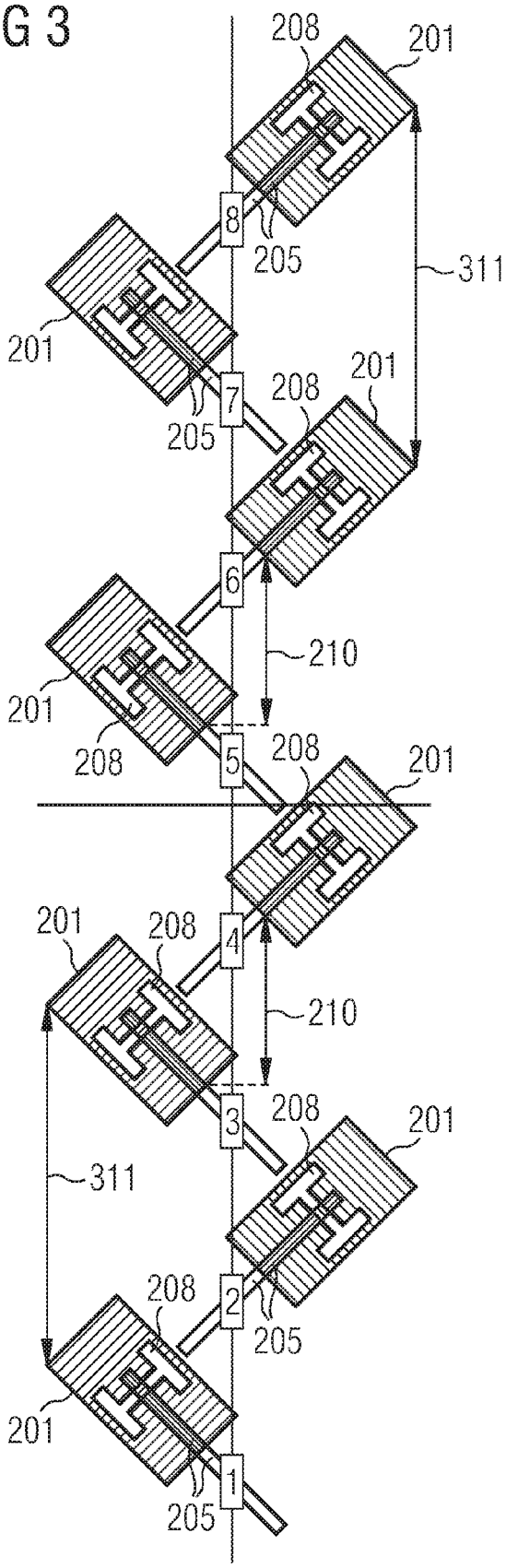
FIG. 3 schematically illustrates a basic 4-unit or 8-element dual polarized patch antenna array.

FIG. 3 schematically illustrates a basic 4-unit or 8-element dual polarized patch antenna array which is vertically stacked. The vertically stacked array consists of four basic units as shown in FIG. 2. The vertical displacement 311 of adjacent elements of the same polarization is 0.6 $\lambda_0$. The eight patch antenna elements 201 are identical to each other.

Figure 4A:
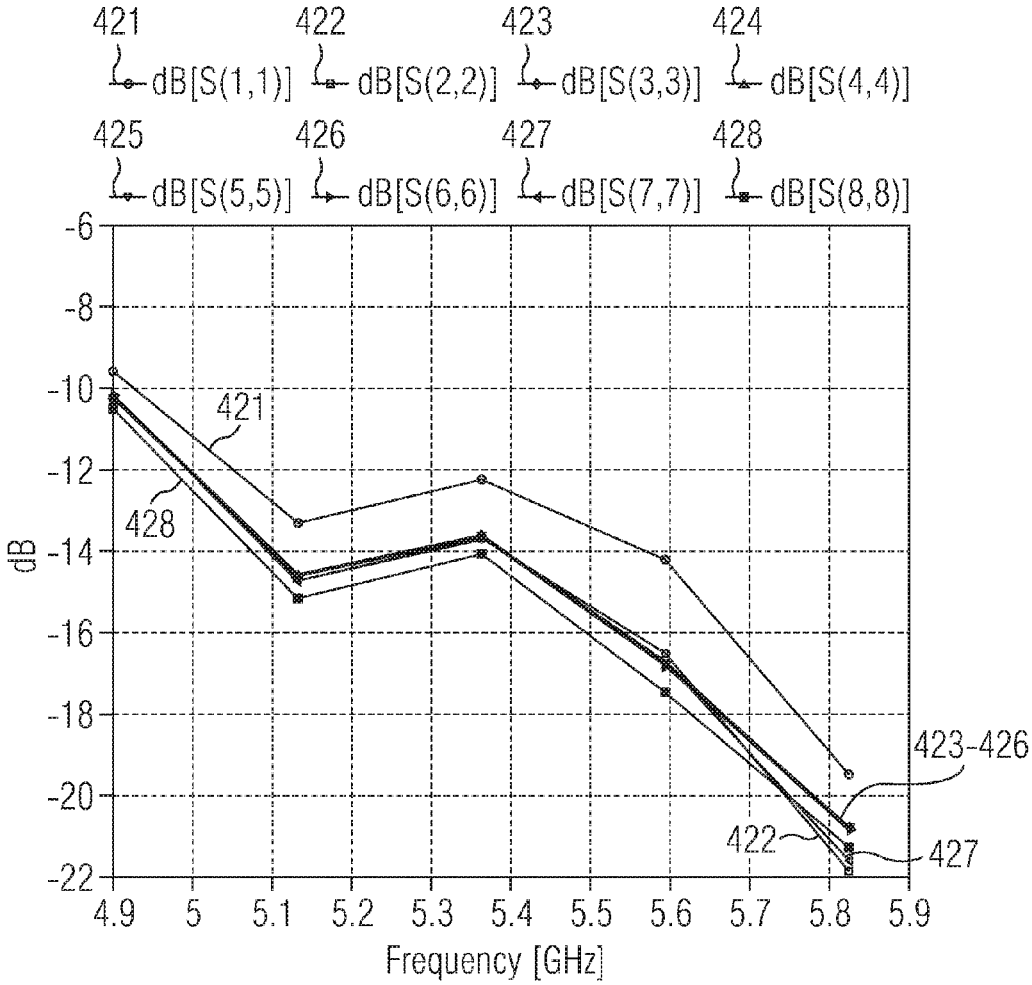
FIGS. 4A-4B schematically illustrate matching (top) and isolation (bottom) of the basic 4-unit or 8-element dual polarized patch antenna array.
Figure 4B:
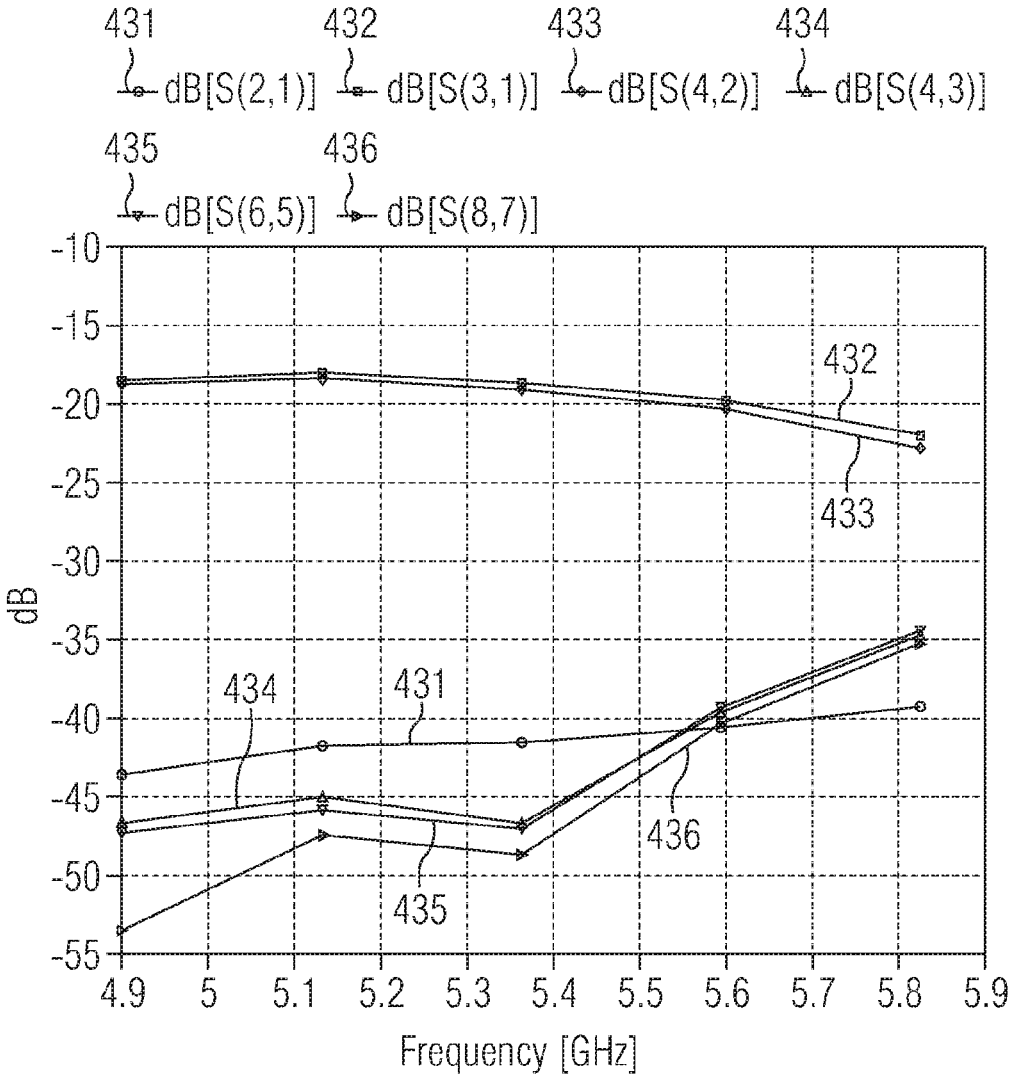

In FIG. 4 simulated matching (FIG. 4A) and isolation figures (FIG. 4B) are shown. FIG. 4 shows that matching is better than −10 dB and polarization isolation better than −35 dB over the band of interest, while mutual coupling between adjacent elements is better than −18 dB.

In the FIG. 4A line 421 indicates the matching between antenna elements shown at the bottom in FIG. 3 and indicated by label 1. Line 422 indicates the matching between antenna elements indicated by label 2 in FIG. 3. Line 423 indicates the matching between antenna elements indicated by label 3 in FIG. 3. Line 424 indicates the matching between antenna elements indicated by label 4 in FIG. 3. Line 425 indicates the matching between antenna elements indicated by label 5 in FIG. 3. Line 426 indicates the matching between antenna elements indicated by label 6 in FIG. 3. Line 427 indicates the matching between antenna elements indicated by label 7 in FIG. 3. Line 428 indicates the matching between antenna elements indicated by label 8 in FIG. 3.

In the FIG. 4B line 431 indicates the isolation between antenna elements labelled 2 and 1 in FIG. 3. Line 432 indicates the isolation between antenna elements labelled 3 and 1 in FIG. 3. Line 433 indicates the isolation between antenna elements labelled 4 and 2 in FIG. 3. Line 434 indicates the isolation between antenna elements labelled 4 and 3 in FIG. 3. Line 435 indicates the isolation between antenna elements labelled 6 and 5 in FIG. 3. Line 436 indicates the isolation between antenna elements labelled 8 and 7 in FIG. 3. It should be noted the labelling or numbering is from the bottom to the top in FIG. 3.

Figure 5A:
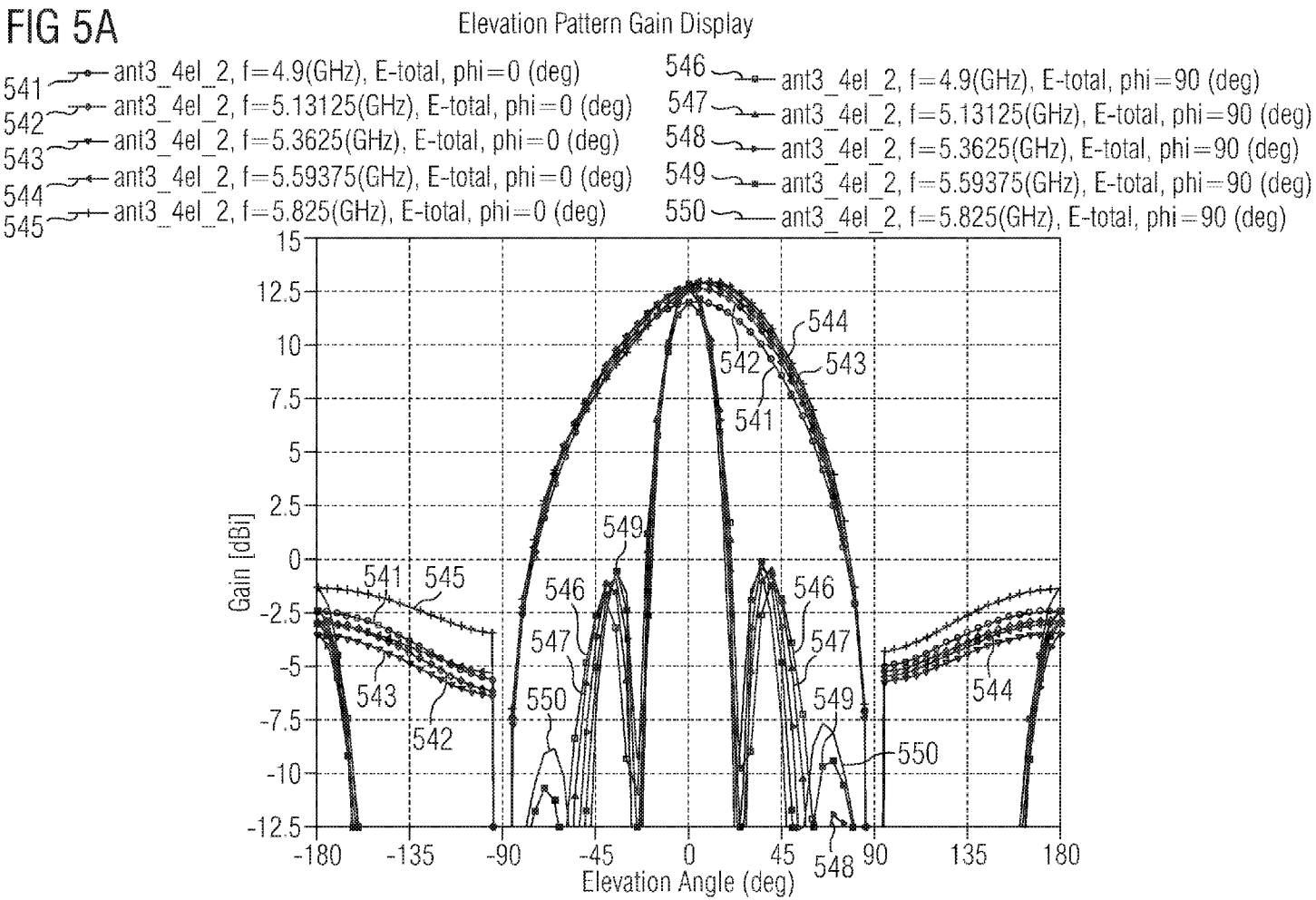
FIGS. 5A-5B schematically illustrate simulated radiation patterns at -45 deg (top) and +45 deg (bottom) polarizations for the basic 4-unit or 8-element dual polarized patch antenna array.
Figure 5B:
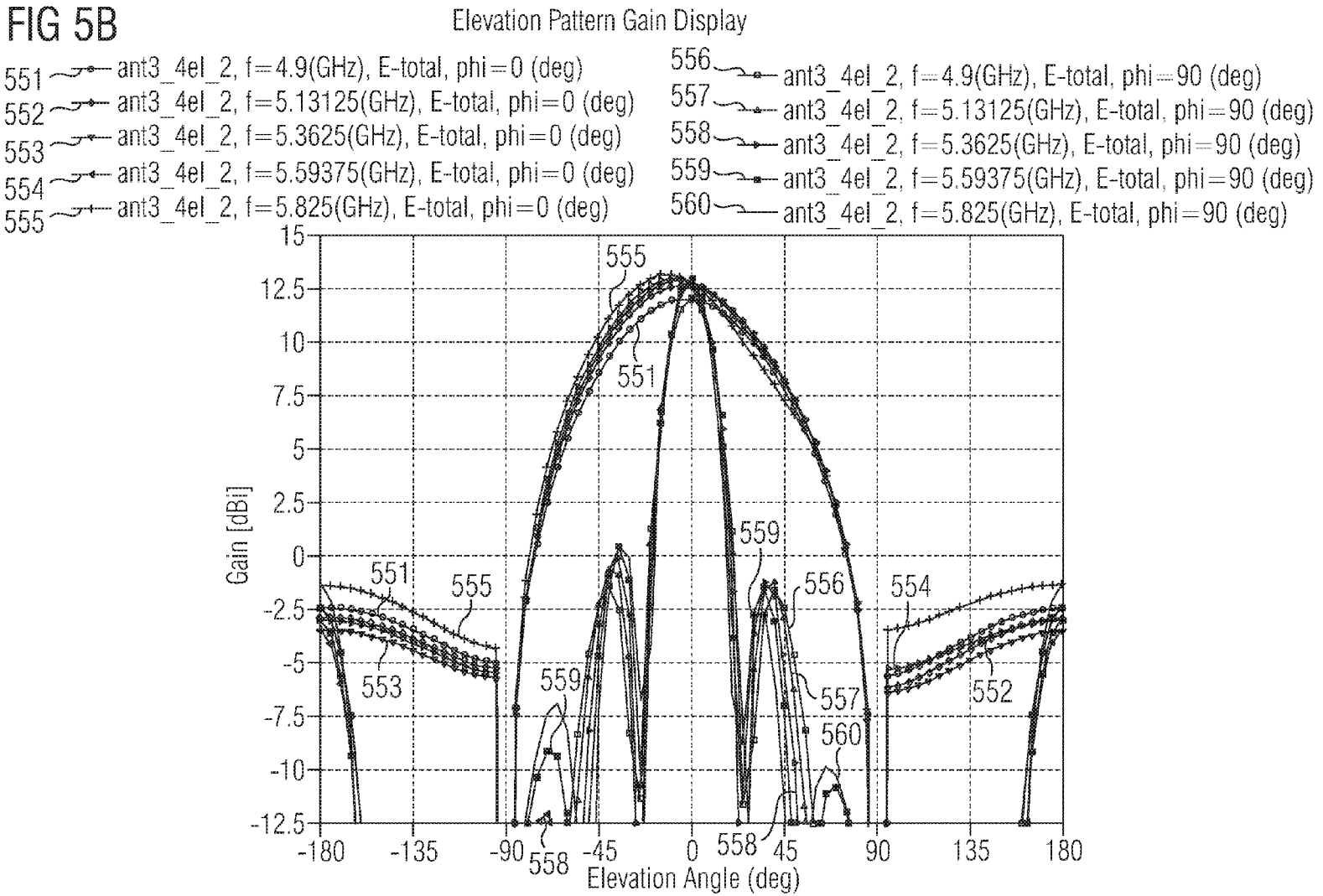

FIG. 5 schematically illustrates simulated radiation patterns at −45 deg (FIG. 5A) and +45 deg (FIG. 5B) polarizations for the basic 4-unit or 8-element dual polarized patch antenna array. In particular, simulated radiation patterns (horizontal and vertical cuts) on both polarizations are shown in FIG. 5. Horizontal beamwidths are about 75 degrees. The horizontal cuts show a frequency dependent tilt in main beam direction which is caused by the offset patch radiators. Peak gain is 13 dBi. Simulated cross-polarization levels are not shown but are below −20 dB.

In particular, in FIG. 5A line 541 corresponds to a frequency of 4.9 GHz and a phi of 0 degrees. Line 542 corresponds to a frequency of 5.13125 GHz and a phi of 0 degrees. Line 543 corresponds to a frequency of 5.3625 GHz and a phi of 0 degrees. Line 544 corresponds to a frequency of 5.59375 GHz and a phi of 0 degrees. Line 545 corresponds to a frequency of 5.825 GHz and a phi of 0 degrees. Line 546 corresponds to a frequency of 4.9 GHz and a phi of 90 degrees. Line 547 corresponds to a frequency of 5.13125 GHz and a phi of 90 degrees. Line 548 corresponds to a frequency of 5.3625 GHz and a phi of 90 degrees. Line 549 corresponds to a frequency of 5.59375 GHz and a phi of 90 degrees. Line 550 corresponds to a frequency of 5.825 GHz and a phi of 90 degrees.

In particular, in FIG. 5B line 551 corresponds to a frequency of 4.9 GHz and a phi of 0 degrees. Line 552 corresponds to a frequency of 5.13125 GHz and a phi of 0 degrees. Line 553 corresponds to a frequency of 5.3625 GHz and a phi of 0 degrees. Line 554 corresponds to a frequency of 5.59375 GHz and a phi of 0 degrees. Line 555 corresponds to a frequency of 5.825 GHz and a phi of 0 degrees. Line 556 corresponds to a frequency of 4.9 GHz and a phi of 90 degrees. Line 557 corresponds to a frequency of 5.13125 GHz and a phi of 90 degrees. Line 558 corresponds to a frequency of 5.3625 GHz and a phi of 90 degrees. Line 559 corresponds to a frequency of 5.59375 GHz and a phi of 90 degrees. Line 560 corresponds to a frequency of 5.825 GHz and a phi of 90 degrees.

Figure 6A:
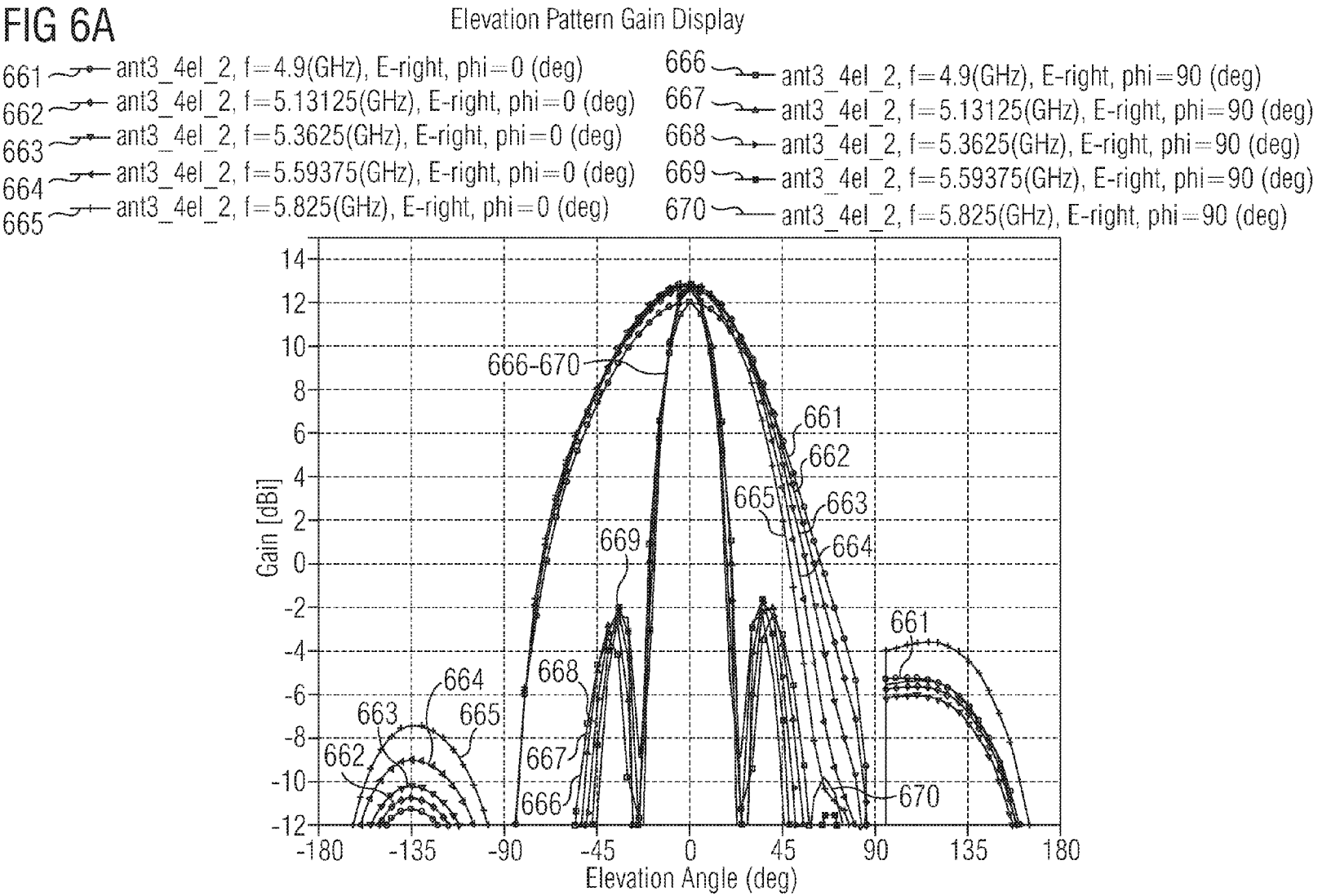
FIGS. 6A-6B schematically illustrate simulated radiation patterns on circular main polarization E_right (top) and circular cross-polarization E_left (bottom) for the basic 4-unit or 8-element dual polarized patch antenna array.
Figure 6B:
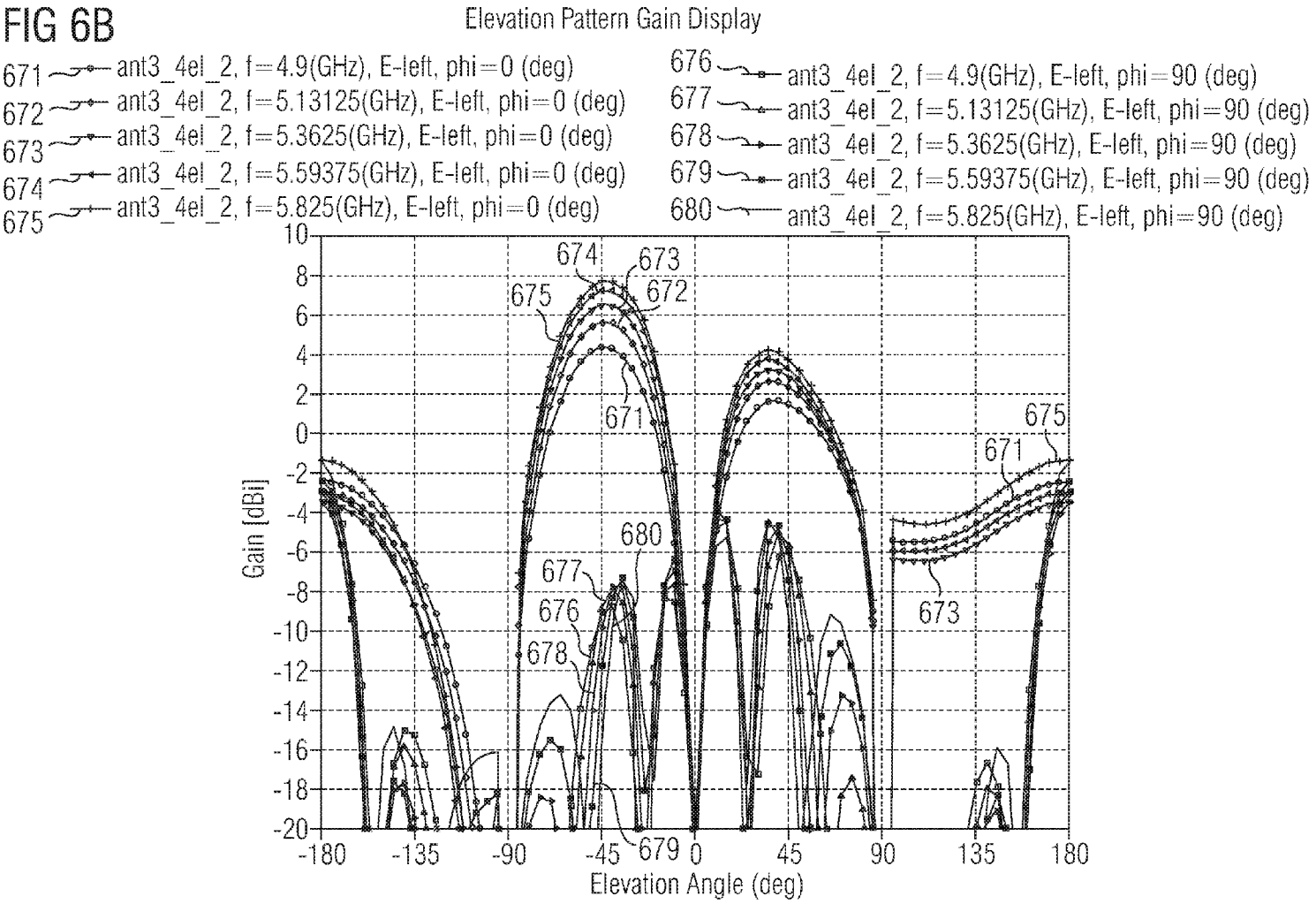

FIG. 6 schematically illustrates simulated radiation patterns on circular main polarization E_right (FIG. 6A) and circular cross-polarization E_left (FIG. 6B) for the basic 4-unit or 8-element dual polarized patch antenna array. Simulated cross-polarization levels are not shown but are below −20 dB. Simulated circularly polarized radiation patterns obtained by quadrature feeding are shown in FIG. 6. The circularly polarized-patterns are suitable, and cross-polarization is very low.

In particular, in FIG. 6A line 661 corresponds to a frequency of 4.9 GHz and a phi of 0 degrees. Line 662 corresponds to a frequency of 5.13125 GHz and a phi of 0 degrees. Line 663 corresponds to a frequency of 5.3625 GHz and a phi of 0 degrees. Line 664 corresponds to a frequency of 5.59375 GHz and a phi of 0 degrees. Line 665 corresponds to a frequency of 5.825 GHz and a phi of 0 degrees. Line 666 corresponds to a frequency of 4.9 GHz and a phi of 90 degrees. Line 667 corresponds to a frequency of 5.13125 GHz and a phi of 90 degrees. Line 668 corresponds to a frequency of 5.3625 GHz and a phi of 90 degrees. Line 669 corresponds to a frequency of 5.59375 GHz and a phi of 90 degrees. Line 670 corresponds to a frequency of 5.825 GHz and a phi of 90 degrees.

In particular, in FIG. 6B line 671 corresponds to a frequency of 4.9 GHz and a phi of 0 degrees. Line 672 corresponds to a frequency of 5.13125 GHz and a phi of 0 degrees. Line 673 corresponds to a frequency of 5.3625 GHz and a phi of 0 degrees. Line 674 corresponds to a frequency of 5.59375 GHz and a phi of 0 degrees. Line 675 corresponds to a frequency of 5.825 GHz and a phi of 0 degrees. Line 676 corresponds to a frequency of 4.9 GHz and a phi of 90 degrees. Line 677 corresponds to a frequency of 5.13125 GHz and a phi of 90 degrees. Line 678 corresponds to a frequency of 5.3625 GHz and a phi of 90 degrees. Line 679 corresponds to a frequency of 5.59375 GHz and a phi of 90 degrees. Line 680 corresponds to a frequency of 5.825 GHz and a phi of 90 degrees.

Figure 7:
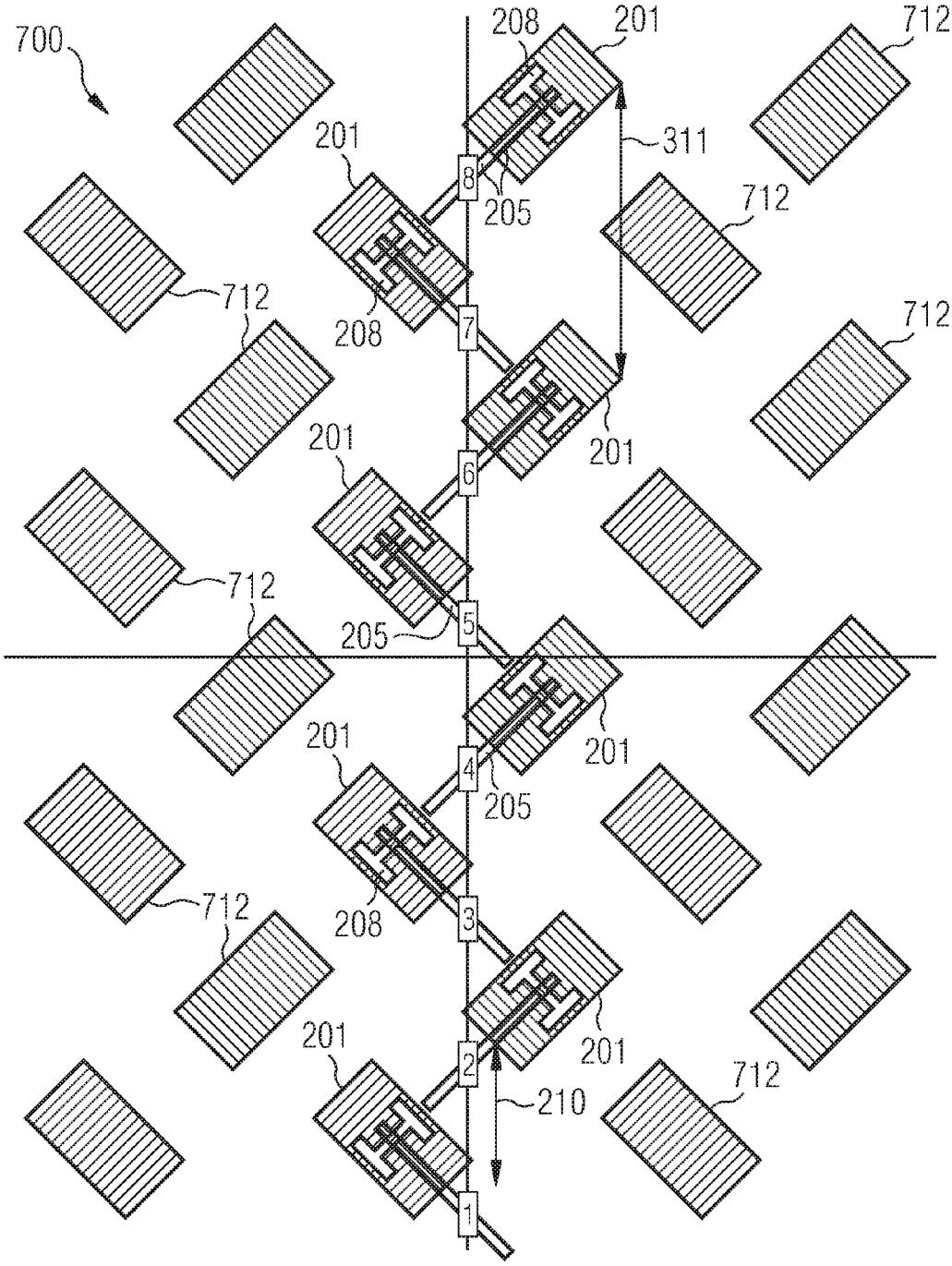
FIG. 7 schematically illustrates an interleaved dual-slant polarized array with parasitic elements.

FIG. 7 schematically illustrates an interleaved dual-slant polarized arrangement 700 with parasitic elements 712. The interleaved dual-slant polarized arrangement 700 is identical to the one shown in FIG. 3 but additionally comprises the parasitic elements 712. The parasitic elements are arranged in the same pattern as the patch antenna elements 701, and are arranged to shape a radiation beam of the antenna arrangement. In particular, the parasitic elements have the same rectangular shape and similar size and are as well arranged in a T-shape pattern. The wide sector coverage antenna array is obtained by using carefully placed parasitic patches around the primary patch antenna elements. The optimized structure is shown in FIG. 7. The parasitic patches are about the same size as the primary patches, and their distance from the primary patch is $\lambda_0$ at mid-band.

Figure 8A:
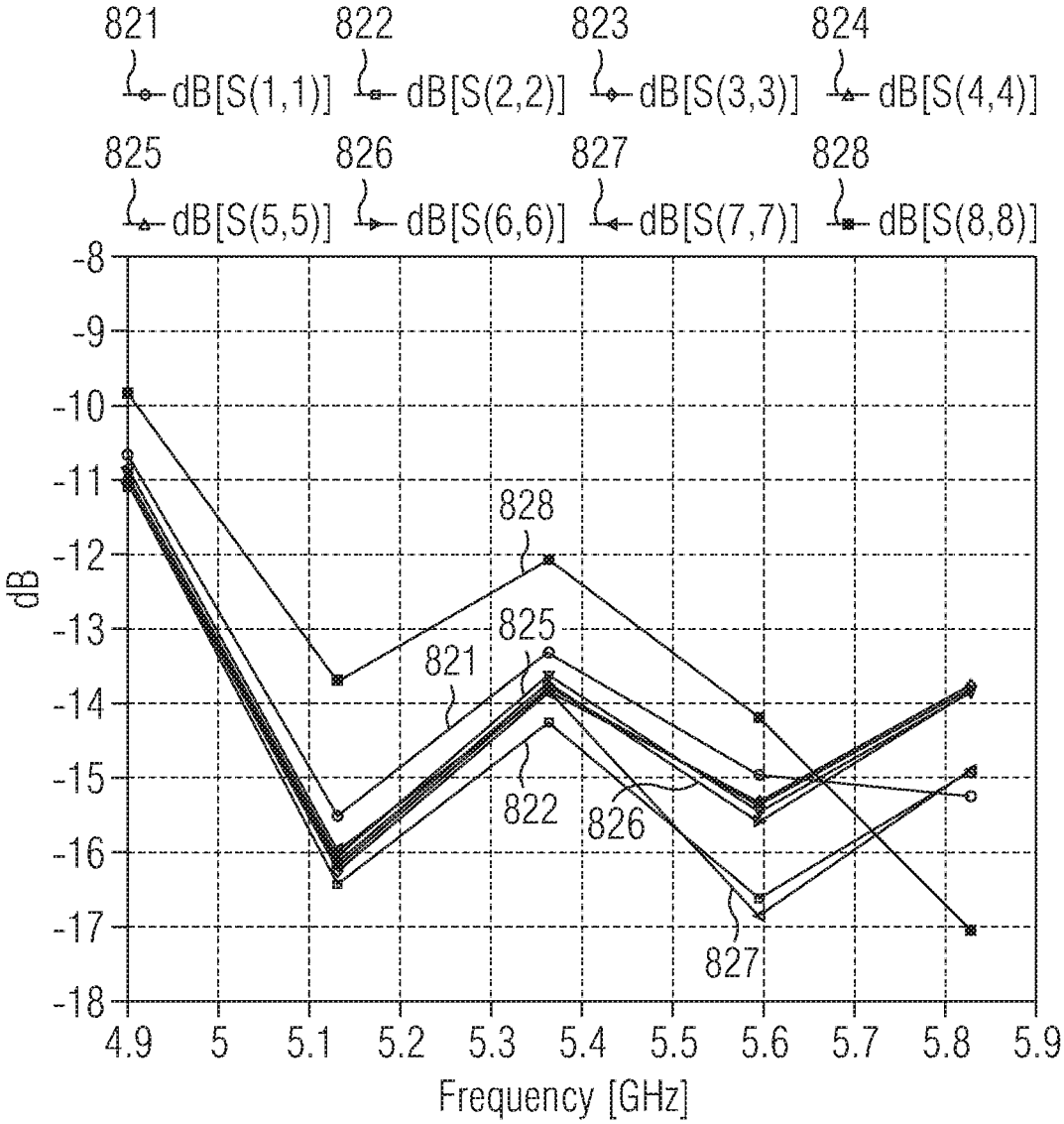
FIGS. 8A-8B schematically illustrate matching (top) and isolation (bottom) of the 4-unit or 8-element dual polarized patch antenna array with parasitics.
Figure 8B:
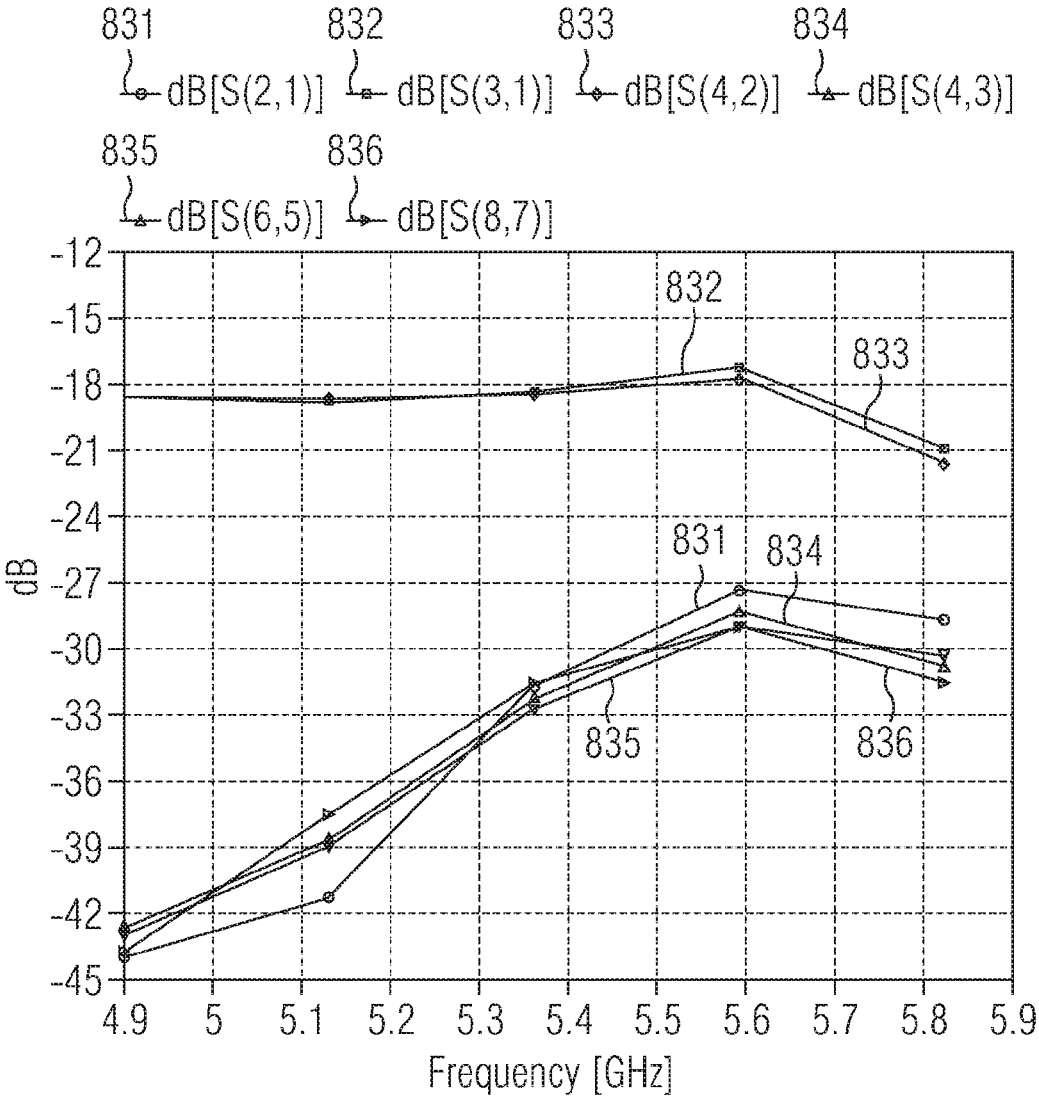

FIG. 8 schematically illustrates matching (FIG. 8A) and isolation (FIG. 8B) of the 4-unit or 8-element dual polarized patch antenna array with parasitic elements. In particular, the simulated matching and isolation figures are shown in FIG. 8. Matching is better than −10 dB and isolation better than −27 dB while mutual coupling is below −17 dB.

In the FIG. 8A line 821 indicates the matching between antenna elements shown at the bottom in FIG. 7 and indicated by label 1. Line 822 indicates the matching between antenna elements indicated by label 2 in FIG. 7. Line 823 indicates the matching between antenna elements indicated by label 3 in FIG. 7. Line 824 indicates the matching between antenna elements indicated by label 4 in FIG. 7. Line 825 indicates the matching between antenna elements indicated by label 5 in FIG. 7. Line 826 indicates the matching between antenna elements indicated by label 6 in FIG. 7. Line 827 indicates the matching between antenna elements indicated by label 7 in FIG. 7. Line 828 indicates the matching between antenna elements indicated by label 8 in FIG. 7.

In the FIG. 8B line 831 indicates the isolation between antenna elements labelled 2 and 1 in FIG. 7. Line 832 indicates the isolation between antenna elements labelled 3 and 1 in FIG. 7. Line 833 indicates the isolation between antenna elements labelled 4 and 2 in FIG. 7. Line 834 indicates the isolation between antenna elements labelled 4 and 3 in FIG. 7. Line 835 indicates the isolation between antenna elements labelled 6 and 5 in FIG. 7. Line 836 indicates the isolation between antenna elements labelled 8 and 7 in FIG. 7. It should be noted the labelling or numbering is from the bottom to the top in FIG. 7.

Figure 9A:
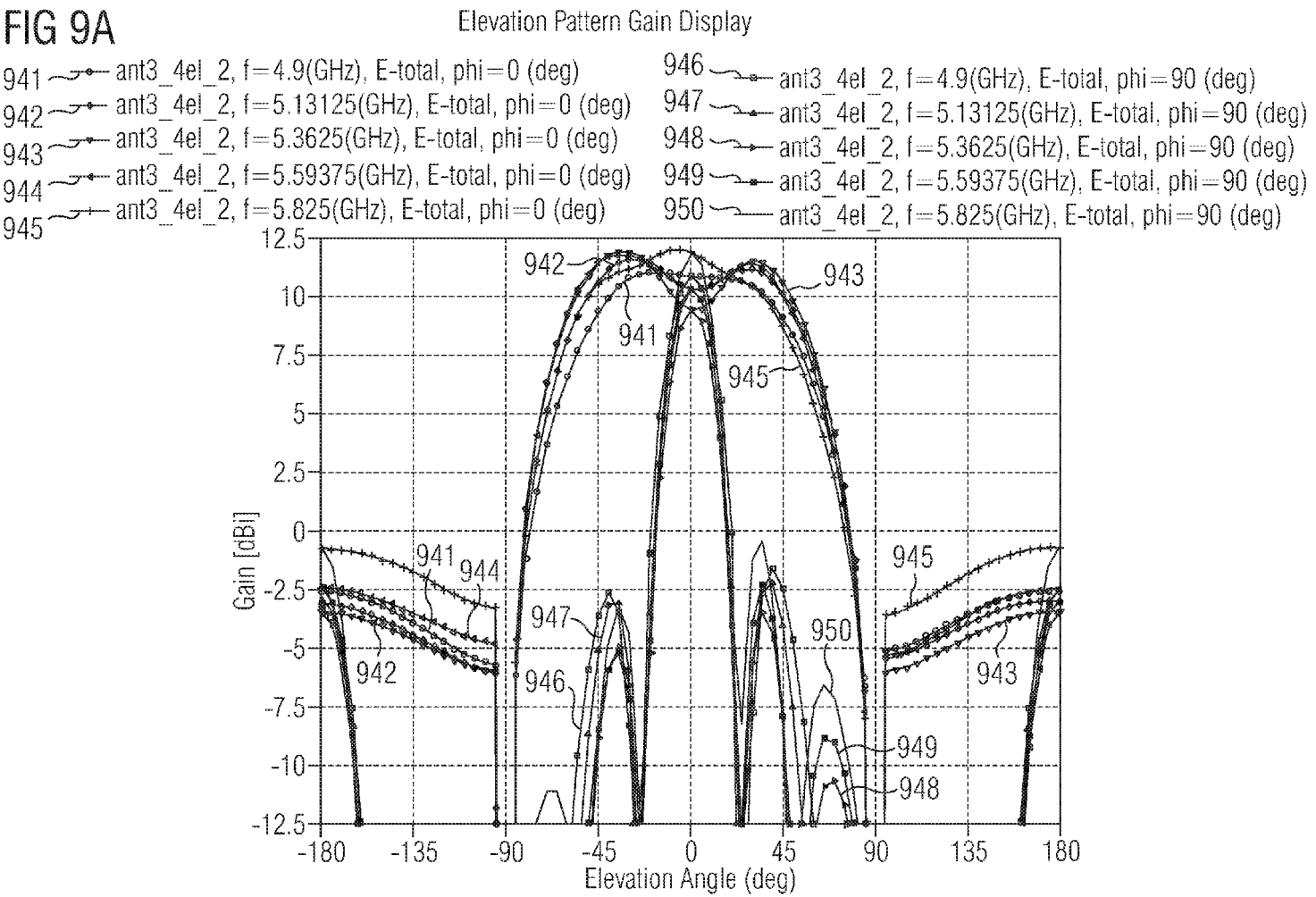
FIGS. 9A-9B schematically illustrate simulated radiation patterns at -45 deg (top) and +45 deg (bottom) polarizations for the 4-unit or 8-element dual polarized patch antenna array with parasitic patches.
Figure 9B:
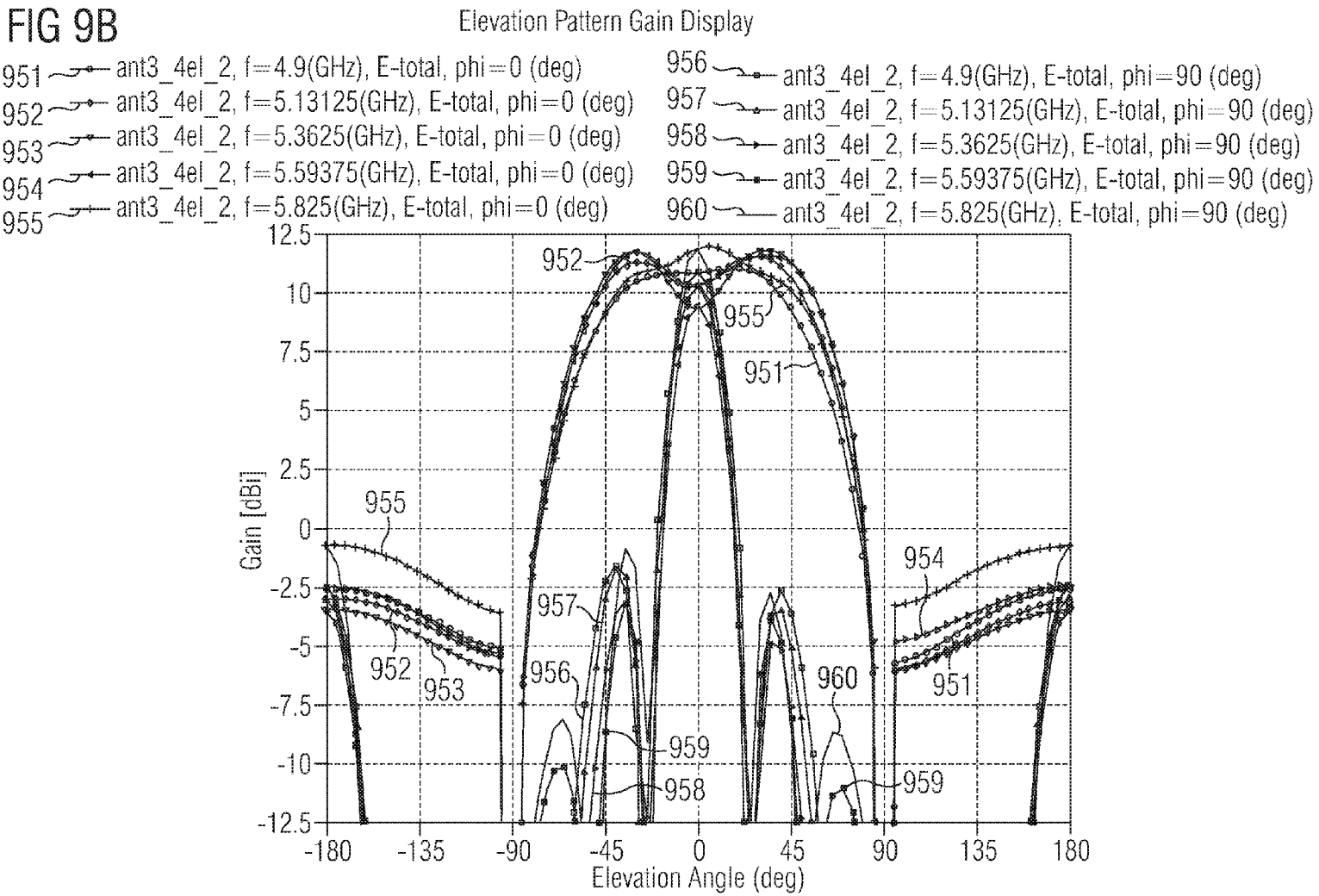

FIG. 9 schematically illustrates simulated radiation patterns at −45 deg (FIG. 9A) and +45 deg (FIG. 9B) polarizations for the 4-unit or 8-element dual polarized patch antenna array with parasitic patches. Simulated radiation patterns (horizontal and vertical cuts) on both polarizations are shown in FIG. 9. Horizontal beamwidths are about 117 degrees at mid-band. Peak gain is 12 dBi. Simulated cross-polarization levels are not shown but are below −20 dB.

In particular, in FIG. 9A line 941 corresponds to a frequency of 4.9 GHz and a phi of 0 degrees. Line 942 corresponds to a frequency of 5.13125 GHz and a phi of 0 degrees. Line 943 corresponds to a frequency of 5.3625 GHz and a phi of 0 degrees. Line 944 corresponds to a frequency of 5.59375 GHz and a phi of 0 degrees. Line 945 corresponds to a frequency of 5.825 GHz and a phi of 0 degrees. Line 946 corresponds to a frequency of 4.9 GHz and a phi of 90 degrees. Line 947 corresponds to a frequency of 5.13125 GHz and a phi of 90 degrees. Line 948 corresponds to a frequency of 5.3625 GHz and a phi of 90 degrees. Line 949 corresponds to a frequency of 5.59375 GHz and a phi of 90 degrees. Line 950 corresponds to a frequency of 5.825 GHz and a phi of 90 degrees.

In particular, in FIG. 9B line 951 corresponds to a frequency of 4.9 GHz and a phi of 0 degrees. Line 952 corresponds to a frequency of 5.13125 GHz and a phi of 0 degrees. Line 953 corresponds to a frequency of 5.3625 GHz and a phi of 0 degrees. Line 954 corresponds to a frequency of 5.59375 GHz and a phi of 0 degrees. Line 955 corresponds to a frequency of 5.825 GHz and a phi of 0 degrees. Line 956 corresponds to a frequency of 4.9 GHz and a phi of 90 degrees. Line 957 corresponds to a frequency of 5.13125 GHz and a phi of 90 degrees. Line 958 corresponds to a frequency of 5.3625 GHz and a phi of 90 degrees. Line 959 corresponds to a frequency of 5.59375 GHz and a phi of 90 degrees. Line 960 corresponds to a frequency of 5.825 GHz and a phi of 90 degrees.

Figure 10A:
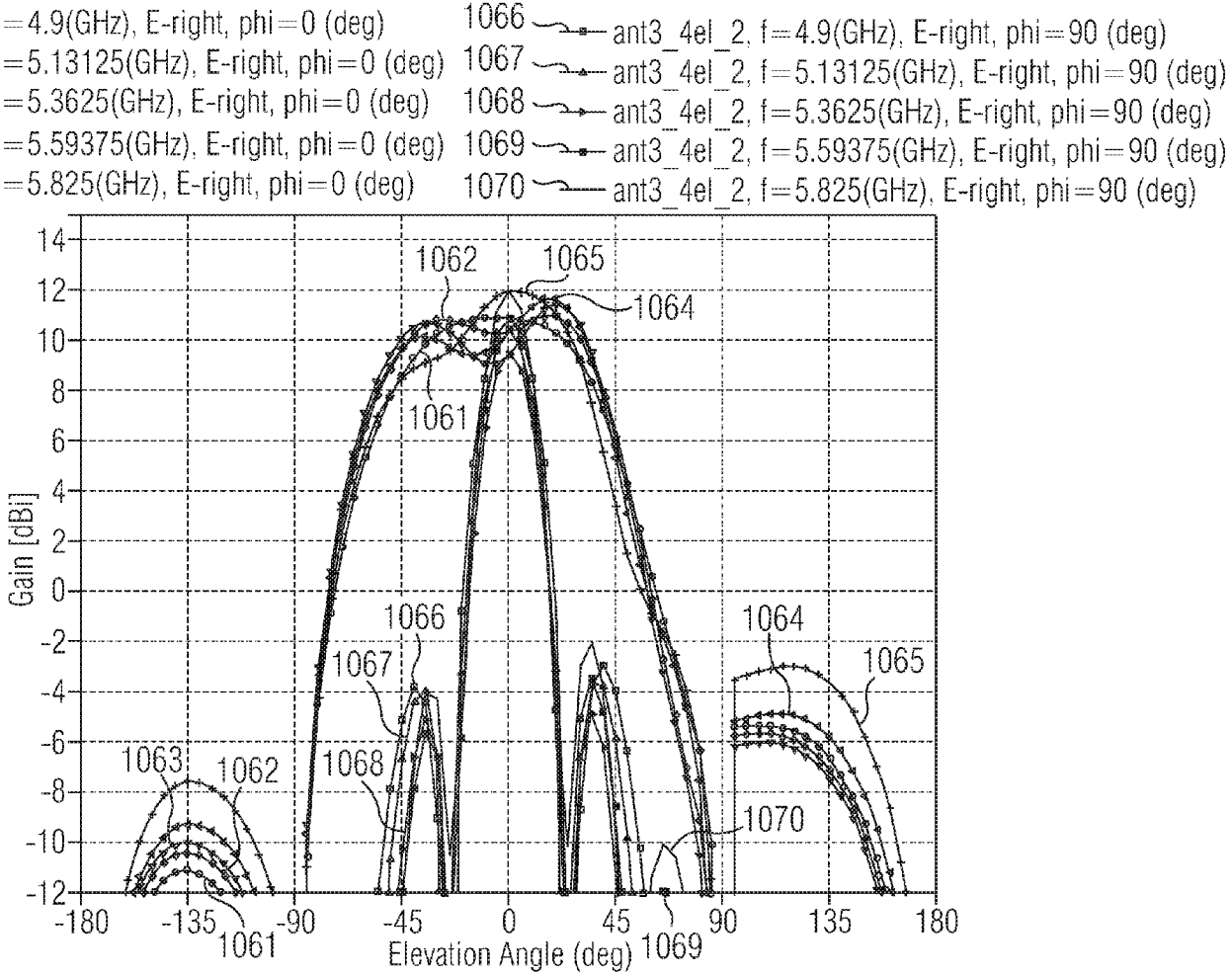
FIGS. 10A-10B schematically illustrate simulated radiation patterns on circular main polarization E_right (top) and circular cross-polarization E_left (bottom) for the 4-unit or 8-element dual polarized patch antenna array with parasitic patches.
Figure 10B:
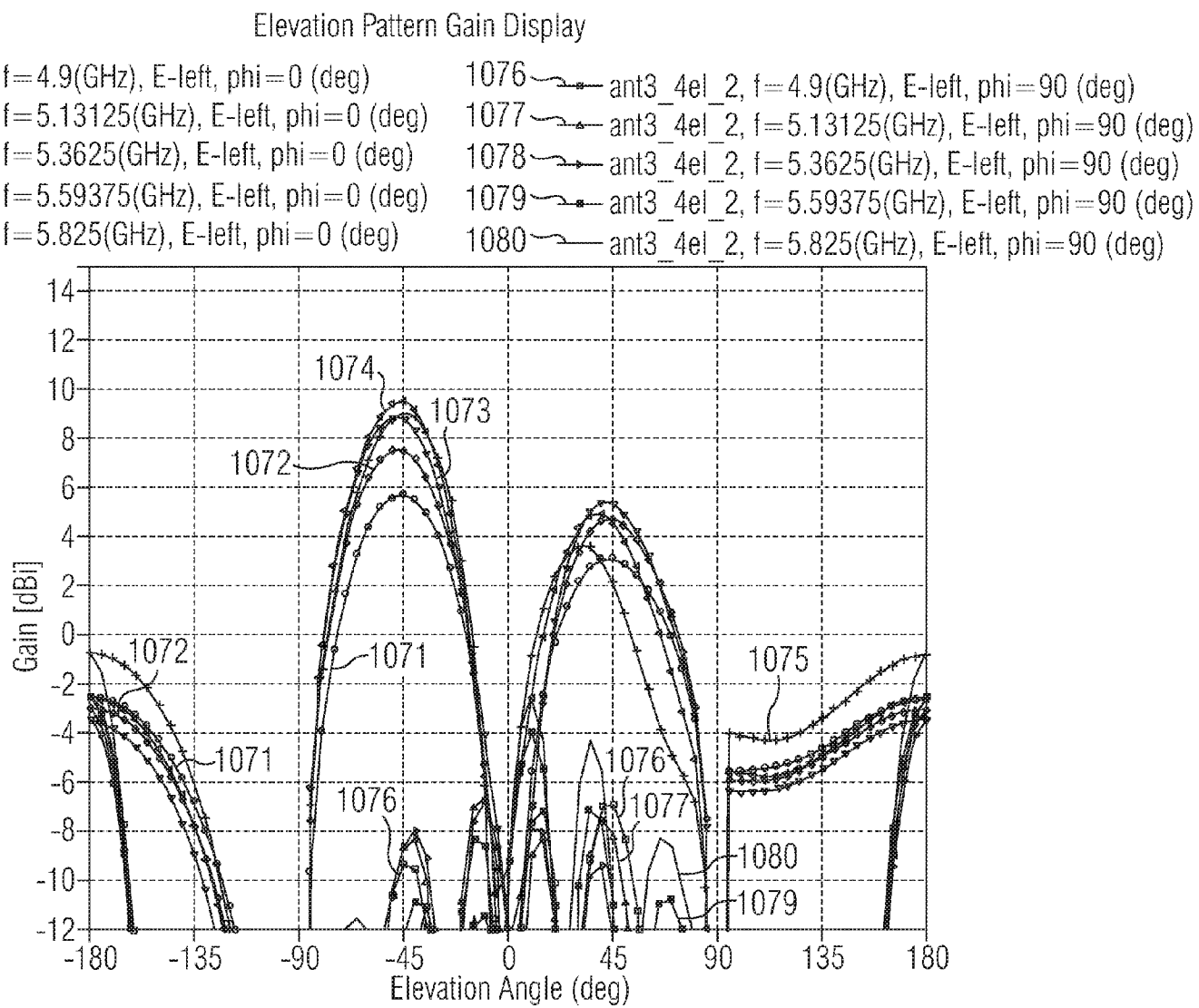

FIG. 10 schematically illustrates simulated radiation patterns on circular main polarization E_right (FIG. 10A) and circular cross-polarization E_left (FIG. 10B) for the 4-unit or 8-element dual polarized patch antenna array with parasitic patches. Simulated circularly polarized radiation patterns obtained by quadrature feeding are shown in FIG. 10. The circularly polarized patterns are suitable, and cross-polarization is very low. Beamwidth is reduced to about 90 degrees in CP-mode.

In particular, in FIG. 10A line 1061 corresponds to a frequency of 4.9 GHz and a phi of 0 degrees. Line 1062 corresponds to a frequency of 5.13125 GHz and a phi of 0 degrees. Line 1063 corresponds to a frequency of 5.3625 GHz and a phi of 0 degrees. Line 1064 corresponds to a frequency of 5.59375 GHz and a phi of 0 degrees. Line 1065 corresponds to a frequency of 5.825 GHz and a phi of 0 degrees. Line 1066 corresponds to a frequency of 4.9 GHz and a phi of 90 degrees. Line 1067 corresponds to a frequency of 5.13125 GHz and a phi of 90 degrees. Line 1068 corresponds to a frequency of 5.3625 GHz and a phi of 90 degrees. Line 1069 corresponds to a frequency of 5.59375 GHz and a phi of 90 degrees. Line 1070 corresponds to a frequency of 5.825 GHz and a phi of 90 degrees.

In particular, in FIG. 10B line 1071 corresponds to a frequency of 4.9 GHz and a phi of 0 degrees. Line 1072 corresponds to a frequency of 5.13125 GHz and a phi of 0 degrees. Line 1073 corresponds to a frequency of 5.3625 GHz and a phi of 0 degrees. Line 1074 corresponds to a frequency of 5.59375 GHz and a phi of 0 degrees. Line 1075 corresponds to a frequency of 5.825 GHz and a phi of 0 degrees. Line 1076 corresponds to a frequency of 4.9 GHz and a phi of 90 degrees. Line 1077 corresponds to a frequency of 5.13125 GHz and a phi of 90 degrees. Line 1078 corresponds to a frequency of 5.3625 GHz and a phi of 90 degrees. Line 1079 corresponds to a frequency of 5.59375 GHz and a phi of 90 degrees. Line 1080 corresponds to a frequency of 5.825 GHz and a phi of 90 degrees.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

LIST OF REFERENCE SIGNS

100 Patch antenna element
101 Primary radiator 101
102 Parasitic patch
103 Parasitic patch
104 Housing
105 Feed line
106 Air gap
107 Coaxical connector
200 Patch antenna element
201 Primary radiator
205 Feed line
207 Vertical axis
208 Slot
210 Offset
300 Patch antenna element
301 Primary radiator
305 Feed line
307 Vertical axis
308 Slot
310 Offset
311 Displacement
421 Line indicating the matching between antenna elements
422 Line indicating the matching between antenna elements
423 Line indicating the matching between antenna elements
424 Line indicating the matching between antenna elements
425 Line indicating the matching between antenna elements
426 Line indicating the matching between antenna elements
427 Line indicating the matching between antenna elements
428 Line indicating the matching between antenna elements
431 Line indicating the isolation between antenna elements
432 Line indicating the isolation between antenna elements
433 Line indicating the isolation between antenna elements
434 Line indicating the isolation between antenna elements
435 Line indicating the isolation between antenna elements
436 Line indicating the isolation between antenna elements
437 Line indicating the isolation between antenna elements
438 Line indicating the isolation between antenna elements
541 Radiation pattern for −45° at 4.9 GHz and phi of 0°
542 Radiation pattern for −45° at 5.13125 GHz and phi of 0°
543 Radiation pattern for −45° at 5.3625 GHz and phi of 0°
544 Radiation pattern for −45° at 5.59375 GHz and phi of 0°
545 Radiation pattern for −45° at 5.825 GHz and phi of 0°
546 Radiation pattern for −45° at 4.9 GHz and phi of 90°
547 Radiation pattern for −45° at 5.13125 GHz and phi of 90°
548 Radiation pattern for −45° at 5.3625 GHz and phi of 90°
549 Radiation pattern for −45° at 5.59375 GHz and phi of 90°
550 Radiation pattern for +45° at 5.825 GHz and phi of 90°
551 Radiation pattern for +45° at 4.9 GHz and phi of 0°
552 Radiation pattern for +45° at 5.13125 GHz and phi of 0°
553 Radiation pattern for +45° at 5.3625 GHz and phi of 0°
554 Radiation pattern for +45° at 5.59375 GHz and phi of 0°
555 Radiation pattern for +45° at 5.825 GHz and phi of 0°
556 Radiation pattern for +45° at 4.9 GHz and phi of 90°
557 Radiation pattern for +45° at 5.13125 GHz and phi of 90°
558 Radiation pattern for +45° at 5.3625 GHz and phi of 90°
559 Radiation pattern for +45° at 5.59375 GHz and phi of 90°
560 Radiation pattern for +45° at 5.825 GHz and phi of 90°
661 Circ. main pol. E_right 4.9 GHz and phi of 0°
662 Circ. main pol. E_right 5.13125 GHz and phi of 0°
663 Circ. main pol. E_right 5.3625 GHz and phi of 0°
664 Circ. main pol. E_right 5.59375 GHz and phi of 0°
655 Circ. main pol. E_right 5.825 GHz and phi of 0°
656 Circ. main pol. E_right 4.9 GHz and phi of 90°
657 Circ. main pol. E_right 5.13125 GHz and phi of 90°
668 Circ. main pol. E_right 5.3625 GHz and phi of 90°
669 Circ. main pol. E_right 5.59375 GHz and phi of 90°
670 Circ. main pol. E_right 5.825 GHz and phi of 90°
671 Circ. cross pol. E_left 4.9 GHz and phi of 0°
672 Circ. cross pol. E_left 5.13125 GHz and phi of 0°
673 Circ. cross pol. E_left 5.3625 GHz and phi of 0°
674 Circ. cross pol. E_left 5.59375 GHz and phi of 0°
675 Circ. cross pol. E_left 5.825 GHz and phi of 0°
676 Circ. cross pol. E_left 4.9 GHz and phi of 90°
677 Circ. cross pol. E_left 5.13125 GHz and phi of 90°
678 Circ. cross pol. E_left 5.3625 GHz and phi of 90°
679 Circ. cross pol. E_left 5.59375 GHz and phi of 90°
680 Circ. cross pol. E_left 5.825 GHz and phi of 90°
700 Patch antenna element
701 Primary radiator
705 Feed line
707 Vertical axis
708 Slot
709 Bridging element
710 Offset
711 Displacement

712 Parasitic element
821 Line indicating the matching between antenna elements
822 Line indicating the matching between antenna elements
823 Line indicating the matching between antenna elements
824 Line indicating the matching between antenna elements
825 Line indicating the matching between antenna elements
826 Line indicating the matching between antenna elements
827 Line indicating the matching between antenna elements
828 Line indicating the matching between antenna elements
831 Line indicating the isolation between antenna elements
832 Line indicating the isolation between antenna elements
833 Line indicating the isolation between antenna elements
834 Line indicating the isolation between antenna elements
835 Line indicating the isolation between antenna elements
836 Line indicating the isolation between antenna elements
837 Line indicating the isolation between antenna elements
838 Line indicating the isolation between antenna elements
941 Radiation pattern for −45° at 4.9 GHz and phi of 0°
942 Radiation pattern for −45° at 5.13125 GHz and phi of 0°
943 Radiation pattern for −45° at 5.3625 GHz and phi of 0°
944 Radiation pattern for −45° at 5.59375 GHz and phi of 0°
945 Radiation pattern for −45° at 5.825 GHz and phi of 0°
946 Radiation pattern for −45° at 4.9 GHz and phi of 90°
947 Radiation pattern for −45° at 5.13125 GHz and phi of 90°
948 Radiation pattern for −45° at 5.3625 GHz and phi of 90°
949 Radiation pattern for −45° at 5.59375 GHz and phi of 90°
950 Radiation pattern for +45° at 5.825 GHz and phi of 90°
951 Radiation pattern for +45° at 4.9 GHz and phi of 0°
952 Radiation pattern for +45° at 5.13125 GHz and phi of 0°
953 Radiation pattern for +45° at 5.3625 GHz and phi of 0°
954 Radiation pattern for +45° at 5.59375 GHz and phi of 0°
955 Radiation pattern for +45° at 5.825 GHz and phi of 0°
956 Radiation pattern for +45° at 4.9 GHz and phi of 90°
957 Radiation pattern for +45° at 5.13125 GHz and phi of 90°
958 Radiation pattern for +45° at 5.3625 GHz and phi of 90°
959 Radiation pattern for +45° at 5.59375 GHz and phi of 90°
960 Radiation pattern for +45° at 5.825 GHz and phi of 90°
1061 Circ. main pol. E_right 4.9 GHz and phi of 0°
1062 Circ. main pol. E_right 5.13125 GHz and phi of 0°
1063 Circ. main pol. E_right 5.3625 GHz and phi of 0°
1064 Circ. main pol. E_right 5.59375 GHz and phi of 0°
1055 Circ. main pol. E_right 5.825 GHz and phi of 0°
1056 Circ. main pol. E_right 4.9 GHz and phi of 90°
1057 Circ. main pol. E_right 5.13125 GHz and phi of 90°
1068 Circ. main pol. E_right 5.3625 GHz and phi of 90°
1069 Circ. main pol. E_right 5.59375 GHz and phi of 90°
1070 Circ. main pol. E_right 5.825 GHz and phi of 90°
1071 Circ. cross pol. E_left 4.9 GHz and phi of 0°
1072 Circ. cross pol. E_left 5.13125 GHz and phi of 0°
1073 Circ. cross pol. E_left 5.3625 GHz and phi of 0°
1074 Circ. cross pol. E_left 5.59375 GHz and phi of 0°
1075 Circ. cross pol. E_left 5.825 GHz and phi of 0°
1076 Circ. cross pol. E_left 4.9 GHz and phi of 90°
1077 Circ. cross pol. E_left 5.13125 GHz and phi of 90°
1078 Circ. cross pol. E_left 5.3625 GHz and phi of 90°
1079 Circ. cross pol. E_left 5.59375 GHz and phi of 90°
1080 Circ. cross pol. E_left 5.825 GHz and phi of 90°

The invention claimed is:

1. A communication network antenna array comprising:
a first patch antenna element,
a second patch antenna element,
a third patch antenna element,
wherein the first patch antenna element is adapted for transmission and/or reception of electromagnetic radiation polarized in a first direction,
wherein the second patch antenna element is adapted for transmission and/or reception of electromagnetic radiation polarized in a second direction,
wherein the third patch antenna element is adapted for transmission and/or reception of electromagnetic radiation polarized in a third direction,
wherein the first, the second and the third patch antenna elements are arranged equidistant to a straight axis, and wherein the first direction, the second direction, and the third direction define an acute angle with the straight axis, and
further comprising:
a plurality of parasitic elements arranged farther away from the straight axis than the patch antenna elements.

2. The antenna array according to claim 1, wherein the first and the third direction are the same.

3. The antenna array according to claim 1, wherein the acute angle is in the range between 25 and 65 degrees.

4. The antenna array according to claim 1, wherein the first, second and third patch antenna elements have the same shape.

5. The antenna array according to claim 1, wherein adjacent patch antenna elements are arranged on alternative sides of the straight axis.

6. The antenna array according to claim 5, wherein an offset of the adjacent patch antenna elements is between 0.2 and 0.4 times the free-space wavelength of the electromagnetic radiation of the respective patch antenna, wherein the offset is measured in parallel to the straight axis.

7. The antenna array according to claim 5, wherein a displacement of the patch antenna elements arranged on the same side of the straight axis is between 0.4 and 0.8 times the free-space wavelength of the electromagnetic radiation of the respective patch antenna, wherein the displacement is measured in parallel to the straight axis.

8. The antenna array according to claim 1, wherein the parasitic elements are shaped and arranged to shape a radiation beam of the antenna array.

9. The antenna array according to claim 1, wherein the patch antenna elements have an rectangular shape,
wherein the plurality of parasitic elements have the same shape as the patch antenna elements, and
wherein the plurality of parasitic elements are arranged in a corresponding pattern to the pattern formed by the patch antenna elements.

10. The antenna array according to claim 1, wherein at least one of the patch antenna elements comprises a conductive planar layer, and wherein the conductive planar layer comprises at least one H-slot.

11. The antenna array according to claim 10, further comprising:
a feed line, wherein the feed line extends over the H-slot.

12. The antenna array according to claim 1, wherein the straight axis is a vertical axis.

13. An antenna arrangement comprising:
a plurality of antenna arrays according to claim 1.

* * * * *